343-754 SR
8/17/82 OR 4,345,256

United States Patent [19]

Rainwater

[11] 4,345,256

[45] Aug. 17, 1982

[54] STEERABLE DIRECTIONAL ANTENNA

[75] Inventor: Lawrence L. Rainwater, Sunnyvale, Calif.

[73] Assignee: Sperry Corporation, New York, N.Y.

[21] Appl. No.: 216,455

[22] Filed: Dec. 15, 1980

[51] Int. Cl.[3] ..... H01Q 19/08; H01Q 3/08

[52] U.S. Cl. ..... 343/754; 343/765

[58] Field of Search ..... 343/762, 763, 765, 766, 343/757, 754; 333/261

[56] References Cited

U.S. PATENT DOCUMENTS

| | | |
|---|---|---|
| 2,434,925 | 1/1948 | Haxby . |
| 2,473,443 | 6/1949 | Ragan . |
| 2,523,320 | 9/1950 | Mieher et al. . |
| 2,784,383 | 3/1957 | Zaleski . |
| 2,812,503 | 11/1957 | Riblet et al. . |
| 2,830,276 | 4/1958 | Zaleski . |
| 3,011,137 | 11/1961 | Albanese et al. . |
| 3,042,886 | 7/1962 | Lundstrom et al. . |
| 3,081,048 | 3/1963 | Lapham, Jr. . |
| 4,020,431 | 4/1977 | Saunders . |

*Primary Examiner*—Eli Lieberman
*Attorney, Agent, or Firm*—John B. Sowell; Kenneth T. Grace; Marshall M. Truex

[57] ABSTRACT

A steerable directional antenna assembly steerable about two perpendicular axes is disclosed. It comprises a directional horn antenna rotatably mounted on a horseshoe gimbal to rotate about a first axis. A curved wave guide feed is connected at one end to the feed portion of the directional antenna. The wave guide feed is disposed such that its center of curvature is located on the first axis of rotation. The curved wave guide has a circumferential slot in its outer side, the slot communicating between the ambient atmosphere and the wave guide interior. The gimbal and directional antenna are rotatably connected to a pedestal which is enabled to rotate the gimbal and directional antenna about a second axis which is perpendicular to the first axis. The antenna assembly further comprises a coaxial feed line which passes through an opening in the pedestal and is fixed to the pedestal. The outer conductor of the coaxial feed line is stripped away from one end of the line to expose the center conductor. The center conductor terminates in an enlarged probe portion. The curved wave guide feed is disposed to receive the center conductor through the circumferential slot and the enlarged probe portion is located within the wave guide interior. A reflecting plate is also disposed within the wave guide interior at a predetermined distance from the enlarged probe portion. The reflecting plate is rotatably connected through the slot to the coaxial feed line. The reflecting plate cooperates with the wave guide and enlarged probe portion to couple RF energy between the coaxial feed line and the directional antenna. It forces RF energy to propagate between the probe and the feed portion of the directional antenna regardless of the position of the directional antenna in rotation about the first axis. When the antenna is caused to rotate about the first axis the curved wave guide feed moves relative to the center conductor and enlarged probe portion along the circumferential slot. When the directional antenna is caused to rotate about the second axis the reflecting plate rotates about the second axis to cause all the RF energy to propagate between the enlarged probe and the feed portion of the directional antenna.

5 Claims, 4 Drawing Figures

STEERABLE DIRECTIONAL ANTENNA

BACKGROUND OF THE INVENTION

This invention relates to a directional antenna steerable in two directions.

An antenna is a means for radiating or receiving radio waves. It provides a transition means between radio waves traveling in free space and radio waves traveling in a transmission line. An antenna is characterized in part by its radiation pattern which can be depicted by a graphical representation of the directions in which energy radiates from the antenna as a function of space coordinates about the antenna. Directional antennas, for example, prefer to radiate more in one region of space than in another. The pattern will reflect this by containing a main beam in the pattern pointing in the preferred direction of radiation. It should be noted that antenna sensitivity to incoming RF energy transmitted to it from different directions is characterized by a receive pattern which is identical to the radiation pattern of the antenna. In other words the antenna will be more sensitive to reception of energy being transmitted to it along its main beam than energy being transmitted along other directions. As used herein the term antenna pattern is used for an antenna receiving or transmitting RF energy. When an antenna is transmitting, an RF signal source is connected by a transmission line to a feed portion of the antenna. When receiving RF energy, a receiver is connected to the feed portion of the antenna.

It is sometimes desirable to rotate a directional antenna about one or more axes to point the main beam of the antenna in a different direction. This process may include rotating the antenna continuously through a range of angles about the axes of rotation (called sweeping or steering the antenna). When the antenna is rotated, the associated transmitter or receiver usually remains stationary. Hence, an RF rotary coupler (called a rotary joint) is provided between the rotating antenna and the stationary receiver or transmitter. However, rotary joints present problems since RF energy must be transmitted therethrough during rotation without attenuation and unwanted RF reflections. As the rotary joint is used more and more, parts within the joint, which move relative to one another to accommodate rotation, and which make continual electrical contact to accommodate RF transmission, begin to wear causing intermittent noise spikes to the RF transmission and eventually total failure. Some examples of RF rotary couplers or joints are given in U. S. Pat. Nos. 2,434,925; 2,473,443; 2,523,320; 2,784,383; 2,812,503; 2,830,276; 3,011,137; 3,042,886; and 4,020,431.Applicant's invention provides an improved steerable antenna having an alternative to conventional RF rotary joints.

SUMMARY OF THE INVENTION

The present invention comprises a directional antenna supported by a gimbal which allows the antenna to be rotated about a first axis. The gimbal and attached directional antenna are rotatably mounted to a turntable or pedestal which is designed to rotate the gimbal and antenna around a second axis perpendicular to the first. A coaxial feedline is fixedly mounted to the pedestal and lies along the second axis of rotation. The center conductor of the coax extends beyond the coax and is terminated in an enlarged probe portion.

The directional antenna is fed by a curved slotted wave guide which is attached at least at one end to the feed portion of the directional antenna. The slot is formed as a circumferential slot in the outer surface of the curved wave guide. The curved wave guide is disposed such that its center of curvature is located on the first axis of rotation. Also, the curved wave guide is positioned such that the extended center conductor passes through the circumferential slot of the wave guide with the probe portion located within the wave guide. When the antenna rotates about either axis, the probe portion remains stationary. The wave guide moves relative to the enlarged probe portion and the extended center conductor along its slot when the directional antenna is rotated about the first axis.

A reflection plate is disposed in the wave guide at a predetermined distance from the probe portion. It too remains stationary when the antenna rotates about the first axis. In the preferred embodiment, the reflecting plate is rotatably connected through the slot to the coaxial feed line such that when the gimbal and antenna rotate about the second axis, the reflection plate pivots about the coaxial feed line.

The directional antenna comprises a wave guide horn and in an alternate embodiment is equipped with a dielectric lens attached to the wave guide aperture to thereby increase its directivity and gain.

The objects, features and advantages of the present invention will become more fully apparent from the following detailed description of the preferred embodiment, the appended claims and the accompanying drawings in which:

DETAILED DESCRIPTION OF THE DRAWINGS

Figure 1:
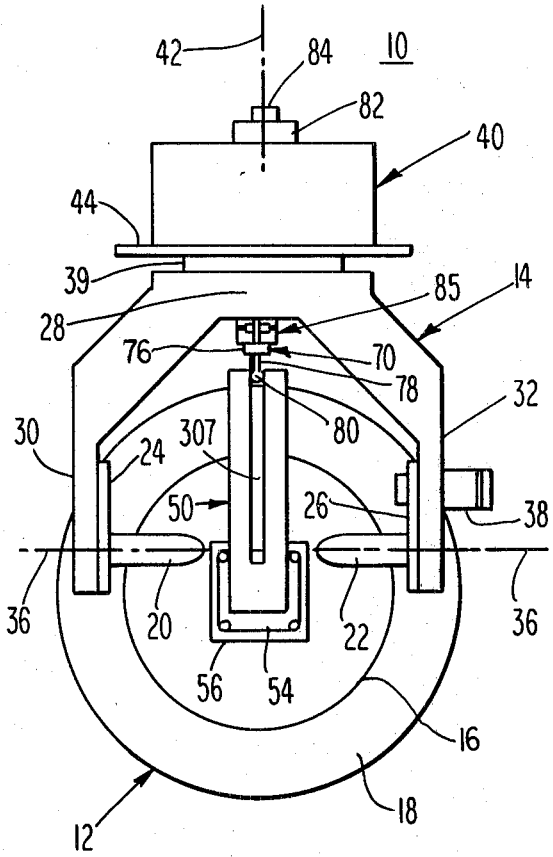
FIG. 1 is a back elevational view of the preferred embodiment of the present invention.

FIG. 1 shows a two axis steerable antenna assembly designated generally 10. It comprises a directional antenna designated generally 12 pivotably supported on a gimbal or first support means designated generally 14. In the preferred embodiment, the directional antenna 12 comprises a wave guide horn 16 and dielectric lens 18 attached to the aperture of the wave guide horn 16. Two arms 20 and 22 attached to the rear conical surface of the horn 16 extend outwardly from the horn in opposite directions. The arms 20 and 22 terminate in flat plates 24 and 26 respectively.

The gimbal 14 is generally in the shape of a horseshoe having a connecting portion 28 and two parallel and spaced apart suspension sections 30 and 32. The flat plates 24 and 26 are rotatably mounted to the inside surfaces of suspension portions 30 and 32, and they allow the directional antenna 12 to rotate about axis 36. Plate 26 is formed with a geared or toothed portion which engages a gear on the shaft of the motor 38 mounted to suspension portion 32. When the motor 38 is activated it rotates plate 26 which in turn rotates the directional antenna 12 about the axis 36.

The connecting portion 28 of gimbal 14 is connected to drive plate 39 of pedestal 40. Pedestal 40 rotates drive plate 39 about axis 42. Pedestal 40 further comprises a mounting plate 44 for mounting pedestal 40 along with the attached gimbal 14 and directional antenna 12 to a host platform.

The antenna assembly 10 further comprises a curved wave guide feed designated generally 50 attached at a first end to horn 16 by an intermediate wave guide feed portion designated generally 52. The feed portion 52 comprises a wave guide bracket 54, which in the preferred embodiment is attached by screws to a throat portion 56 of horn 16, and a combination of straight and curved wave guides sections 58, 60 and 62. The opposite end of curved wave guide feed 50 may or may not be attached to the directional antenna 12. In the preferred embodiment, the curved wave guide feed 50 is disposed with its center of curvature located on the axis of rotation 36.

Figure 3:
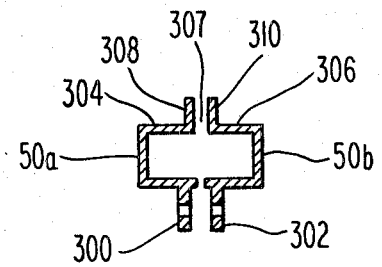
FIG. 3 is an enlarged sectional view of a portion of FIG. 2 taken along the lines and arrows 3—3 in FIG. 2.

FIG. 3 is a cross sectional view of the curved wave guide feed 50. The curved wave guide feed is formed from two symmetrical sections 50*a* and 50*b* which are held together by suitable attachment means such as a nut and bolt through apertures formed in ridge members 300 and 302 which ridge members are attached to sides of sections 50*a* and 50*b* respectively. When held together the sections 50*a* and 50*b* form a curved wave guide having a rectangular cross section. However, the sides 304 and 306 of sections 50*a* and 50*b* respectively, opposite the sides attached to ridge members 300 and 302, do not come in contact with each other but leave a circumferential slot 307 centered in curved wave guide 50. Lip portions 308 and 310 are attached to sides 304 and 306 respectively on either side of slot 307 and they extend away from sides 304 and 306.

Referring to FIG. 1, the antenna assembly 10 further comprises a coaxial feed line designated generally 70. The coaxial feed line is disposed to pass through an opening in pedestal 40 and apertures 72 and 74 in drive plate 39 and connecting portions 28 of gimbal 14 respectively. The axis of the feed line 70 is colinear with the axis 42 of pedestal 40. In a conventional manner, coax 70 is equipped with an outer conductor 76 and a center line conductor 78. In FIG. 1, a section of the outer conductor 76 is separated away from coaxial feed line 70 at one end to expose inner conductor 78. In the preferred embodiment, inner conductor 78 terminates in an enlarged spherically shaped probe or ball 80.

Figure 2:
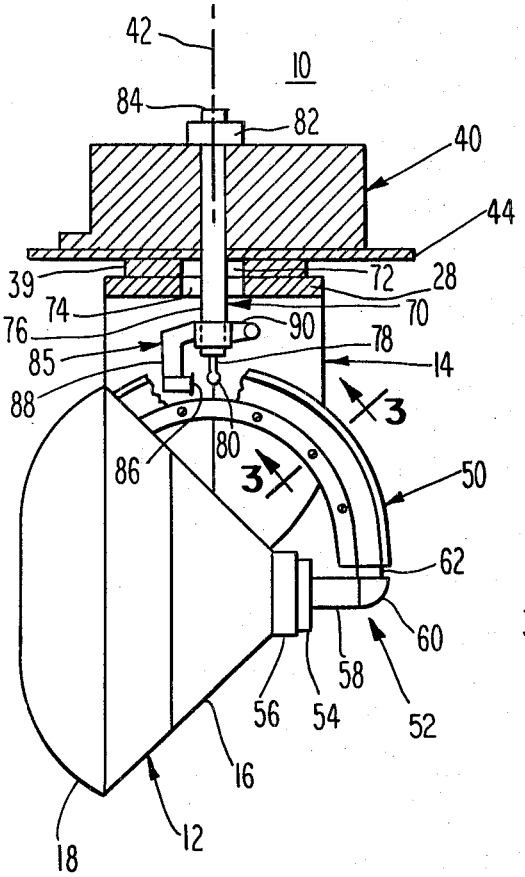
FIG. 2 is a side elevational view of the preferred embodiment of FIG. 1 partially shown in cross section and partially shown broken away.

The position of coaxial feed line 70 within pedestal 40 can be controlled in a number of ways. In FIGS. 1 and 2 the position is fixed by a nut 82 which engages a threaded portion of outer conductor 76 of coaxial feed line 70. The outer conductor is threaded along a portion of its length to allow the coaxial feed line to be moved in one direction or the other through nut 82. When the desired location of coaxial feed line 70 is obtained the nut 82 is tightened against a surface of the pedestal 40. Other means such as a clamping device around coaxial feed line 70 can be used.

The position of coaxial feed line 70 is chosen to place enlarged probe portion 80 within the rectangular wave guide 50 with center conductor 78 passing between lip portions 308 and 310 and through slot 307. The exposed length of center conductor 78 is slightly larger than the height of lip portions 308 and 310 above sides 304 and 306. The arrangement of the exposed center conductor 78 and lip portions 308 and 310 in combination with the probe 80 centered in curved waveguide 50.

Figure 4:
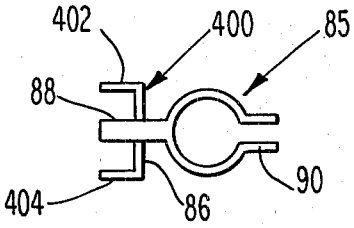
FIG. 4 is an enlarged top view of a portion of FIG. 2.

Antenna assembly 10 further comprises a reflecting means designated generally 85. FIG. 4 is an enlarged top view of reflecting means 85 which comprises a C shaped member 400 including parallel sides 402 and 404 connected together by reflecting plate 86. The C shaped member 400 fits within wave guide 50 with reflecting plate 86 separated from probe portion 80 by a predetermined distance, usually one quarter of a wavelength. Reflecting plate 86 cooperates with wave guide 50 and enlarged probe portion 80 to force propagation of RF energy along wave guide 50 toward the intermediate feed portion 52. This occurs since energy coupled into curved wave guide 50 from probe 80 begins to propagate in two directions along the wave guide. However, RF energy of a given frequency impinging on reflecting plate 86 is reflected back toward probe 80. For a given separation distance between reflecting plate 86 and probe 80, the reflected RF energy is in phase with initially coupled energy from probe 80 traveling toward directional antenna 12. Similarly, the reflecting plate 86 aids in coupling RF energy to probe 80 from curved wave guide 50 where that energy is captured by directional antenna 12 from free space and is traveling toward probe 80 and reflecting plate 86.

Reflecting plate 86 is supported within wave guide 50 by a support member 88 which extends through slot 307. Support member 88 is connected to clamping portion 90 which pivotally surrounds coaxial feed line 70. The reflecting means 85 is free to rotate about coaxial feed line 70 when gimbal 14 and directional antenna 12 rotate about axis 42. Design approaches for rotatably connecting the clamping portion 90 to the coaxial feed line 70 are considered to be well known in the art and are not given here in detail. An example of one approach is to provide a sleeve bearing between the clamping portion 90 and the outer conductor 76. The clamping portion and sleeve can be confined along the length of the coax by C-rings mounted in annular grooves made in the outer conductor 76 of the coax.

When directional antenna 12 is rotated about axis 36 (in elevation) the enlarged portion 80 and reflecting plate 86 remain stationary and curved wave guide 50 moves relative to them with center conductor 78 and support member 88 sitting within slot 307. Hence, for any allowed angle of rotation about axis 36, reflecting plate 86 and probe 80 are positioned within curved wave guide 50 to couple RF energy between directional antenna 12 and coaxial feed line 70.

When directional antenna 12 rotates about axis 42 (azimuth), a side wall of wave guide 50 contacts a parallel side 402 or 404 during rotation and causes the reflecting means 85 to rotate therewith about axis 42. This keeps probe 80 located between reflecting plate 86 and directional antenna 12. Hence for any angle of rotation about axis 42, reflecting plate 86 and probe 80 are positioned within wave guide 50 to couple RF energy between directional antenna 12 and coaxial feed line 70.

Directional antenna 12 can be a single horn antenna with or without the dielectric lens 18 which acts to focus or narrow the beam thereby resulting in higher gain and more directionality. Other directional antennas such as log periodic antennas and reflecting dish antennas may be used in place of wave guide antennas.

While the present invention has been disclosed in connection with the preferred embodiment thereof, it should be understood that there may be other embodiments which fall within the spirit and scope of the invention as defined by the following claims.

What is claimed is:

1. A steerable antenna assembly comprising:

directional antenna means;

first support means attached to said directional antenna means for rotating said directional antenna means about a first axis of rotation;

second support means formed to have said first support means mounted therewith for supporting said first support means;

a coaxial feed line for transmitting RF energy, said feed line having a center conductor with a probe portion connected to one end of said center conductor, said coaxial feed line mounted to said second support means;

wave guide feed line means having a slot formed therein and electrically connected at one end to said directional antenna means, said wave guide feed line means formed to be rotatable about said first axis of rotation, said wave guide feed line means further disposed to have said center conductor extend through said slot whereby said probe is disposed within said wave guide for every angle of rotation of said directional antenna about said first axis; and reflecting means connected to said coaxial feed line and partially disposed within said wave guide feed line means for cooperating with said probe portion and said guide feed line means to couple efficiently RF energy between said directional antenna means and said coaxial feed line.

2. The invention of claim 1 wherein said first support means is rotatably mounted to said second support means, and said second support means is formed to have said first support means rotatable therewith about a second axis of rotation substantially perpendicular to said first axis of rotation, and wherein said reflection means is rotatably coupled to said coaxial feed line whereby when said first support means and said directional antenna are rotated about said second axis said reflection means rotates therewith about said second axis.

3. The invention of claim 1 wherein said directional antenna is a dielectric lens and horn antenna combination.

4. The invention of claims 1 or 2 wherein said waveguide feed line means is curved having a center of curvature lying along said first axis of rotation.

5. The invention of claim 4 wherein said coaxial feedline is adjustably mounted to said second support means.

* * * * *